United States Patent [19]

Akashi

[11] 4,187,591

[45] Feb. 12, 1980

[54] CONTINUOUS SLIDE FASTENER STRINGERS

[75] Inventor: Shunji Akashi, Kurobe, Japan

[73] Assignee: Yoshida Kogyo K K, Tokyo, Japan

[21] Appl. No.: 944,290

[22] Filed: Sep. 21, 1978

Related U.S. Application Data

[63] Continuation of Ser. No. 814,218, Jul. 11, 1977, abandoned.

[30] Foreign Application Priority Data

Jul. 12, 1976 [JP] Japan ..... 51-92624[U]

[51] Int. Cl.[2] ..... A44B 19/00

[52] U.S. Cl. ..... 24/205 R; 24/205.16 R

[58] Field of Search ..... 24/205 R, 205.11 F, 24/205.16 D, 205.16 R

[56] References Cited

U.S. PATENT DOCUMENTS

| | | | |
|---|---|---|---|
| 3,353,256 | 11/1967 | Frohlich | 24/205.11 F |
| 3,456,306 | 7/1969 | Heinberger | 24/205.16 C |
| 3,510,379 | 5/1970 | Heimberger | 24/205.11 F |
| 3,971,868 | 7/1976 | Murai | 24/205.11 F |
| 4,054,973 | 10/1977 | Moertel | 24/205 R |

FOREIGN PATENT DOCUMENTS

| | | | |
|---|---|---|---|
| 2363280 | 7/1974 | Fed. Rep. of Germany | 24/205 R |
| 2461507 | 7/1975 | Fed. Rep. of Germany | 24/205 R |

*Primary Examiner*—Philip C. Kannan

*Attorney, Agent, or Firm*—Bucknam and Archer

[57] ABSTRACT

A pair of slide fastener stringers of continuous or substantially endless length comprising a pair of opposed stringer tapes and a pair of rows of coupling fastener elements carried along the respective confronting inner longitudinal edges of the stringer tapes. Each row of fastener elements has a plurality of sections devoid of fastener elements or at least of the coupling head portions thereof, said sections being spaced at substantially equal intervals defining the ultimate length of an individual fastener product. The end stops are applied to the tapes where the element-free or coupling-head-free sections are located. The tapes are made of thermoplastic synthetic fibers or their blended yarns and have a plurality of openings disposed adjacent to the element-free or coupling-head-free sections and extending across the element rows that have been coupled together. The marginal edges defining the openings are fused with heat.

2 Claims, 3 Drawing Figures

FIG. 1
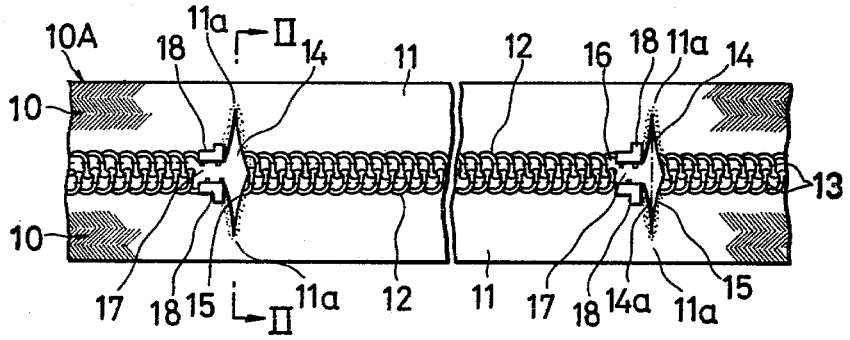
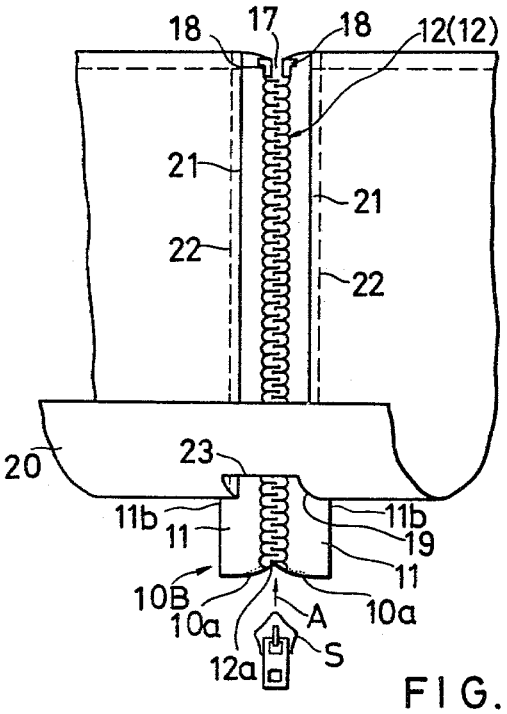
FIG. 3
FIG. 2
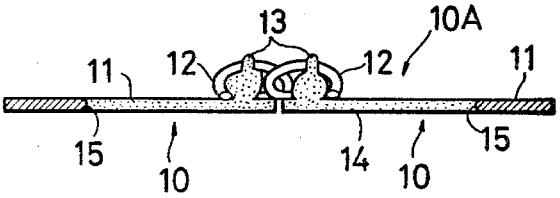

CONTINUOUS SLIDE FASTENER STRINGERS

This is a continuation of application Serial No. 814,218 filed July 11, 1977, now abandoned.

BACKGROUND OF THE INVENTION

1. Field of the Invention

This invention relates to slide fastener stringers of continuous or substantially endless length.

2. Prior Art

Continuous slide fastener stringers generally comprise a pair of opposed continuous stringer tapes and a pair of rows of fastener elements carried along the respective inner longitudinal edges of the stringer tapes, the rows of fastener elements having a plurality of coupling heads. These continuous slide fastener stringers come chiefly into two types. One is of the type that the rows of fastener elements are coupled together through their whole length, and the other is of the type that the rows of fastener elements have a plurality of element-free sections spaced at equal intervals therealong.

It is the usual practice of garment manufacturers to cut the slide fastener stringers, which are supplied in the form of substantially endless chain, into individual slide fastener lengths ready for attachment to a garment. When assembling slider onto the stringers of individual fastener length, the slider would often jerk and fray the edge portions of the stringer tapes, resulting in dislocated tape fibers which in turn would catch and jam the slider against the fastener elements. The fastener elements of helically coiled type, which are sewn to the tape, would be also liable to shift out of position at the element-free sections when the sewn stitches are loosened up.

To eliminate these problems, there have been proposed another type of the continuous slide fastener stringers in which a plurality of openings are formed after pieces of thermoplastic synthetic films being applied onto the fastener stringers around their portions where the respective openings is to be located. However, film residuals left around their cut edge portions of the fastener stringers obstruct a sewing needle in passing therethrough. Further, the film residuals make the garment as well as the fastener stringers to become unsightly.

SUMMARY OF THE INVENTION

It is a primary object of this invention to provide a pair of rows of slide fastener stringers of continuous or substantially endless length which comprise a pair of opposed continuous stringer tapes provided therein with a plurality of openings at substantially equal intervals, the periphery of each opening being fused and hardened so as to prevent the individual fastener lengths from being frayed at their cut edge portions.

It is another object of this invention to provide a pair of slide fastener stringers of continuous or substantially endless length comprising a pair of stringer tapes woven or knitted with thermoplastic fibers or their blended yarns ready for being fused and hardened when once heated.

According to this invention, there are provided, in a pair of stringer tapes made of thermoplastic synthetic fibers, a plurality of openings spaced at substantially equal intervals and extending transversely at least across the coupled rows of fastener elements. The periphery of each opening is fused with heat upon forming of the openings.

Additional object as well as features and advantages of this invention will become evident from the description set forth hereinafter when considered in conjunction with the accompanying drawings.

BRIEF DESCRIPTION OF THE DRAWING

FIG. 1 is a fragmentary plan view of a pair of coupled slide fastener stringers of continuous length according to this invention;

FIG. 2 is an enlarged cross-sectional view taken along the line II—II of FIG. 1; and FIG. 3 is a schematic view showing the manner in which a single individual slide fastener length is attached to a garment.

DETAILED DESCRIPTION OF THE PREFERRED EMBODIMENTS

In the accompanying drawing, FIG. 1 shows a pair of coupled slide fastener stringers 10,10 of continuous or substantially endless length comprising a pair of stringer tapes 11,11 and a pair of helically coiled continuous fastener elements 12,12 each carried on and along their respective confronting inner longitudinal edges of the stringer tapes 11,11 with a pair of rows of stitches, respectively. The pair of the continuous fastener stringers 10,10 are collectively designated by 10A.

The stringer tapes 11,11 are formed of thermoplastic synthetic fibers or their blended yarns by weaving or knitting.

Formed in the continuous fastener stringers 10A, for example by means of a punch, are a plurality of openings 14 spaced at equal intervals. The openings are of a substantially diamond-shaped, and extend transversely across the coupled rows of fastener elements 12,12, terminating short of the outer longitudinal edge of the respective tape, so that the longer diagonal line **14*a* of each diamond is normal to the fastener element rows. Further, with reference to FIGS. 1 and 3, the openings each extend beyond the width of a slider S to be mounted and up to the width of an elongate closure opening 19 formed in a garment 20 to which a single individual slide fastener length 10B manufactured as discussed hereinafter is to be attached. Each opening 14 terminates short of the outer longitudinal edge of the respective tape, with their minor-width outer side portions 11*a*,11*a* left uncut. Moreover, the intervals between any two adjacent openings 14,14 should, of course, be sufficiently longer than the length of the closure opening 19 for attachment of the individual slide fastener length to the periphery of the closure opening 19**.

The openings 14 in the stringer tapes 11,11 are formed by the punch with heat produced with a conventional ultrasonic or high-frequency welder. The peripheries 15 of the respective openings are thus fused and hardened thereafter, since the stringer tapes are made of thermoplastic synthetic fibers or their blended yarns, as discussed hereinabove. As best shown in FIG. 2, threads 13,13 used for attaching the respective fastener elements 12,12 to the respective stringer tapes 11,11 are involved in the fusing and hardening at their trailing cut end portions, thereby resulting in a tight and reliable attachment of the fastener elements to the stringer tapes.

Alternatively, the same results can be obtained by impregnating a solution of a thermoplastic synthetic resin into the continuous fastener stringers 10A at their marginal edge portions 15 defining the openings after the openings have been found.

Returning to FIG. 1, the rows of fastener elements 12,12 of continuous length have a plurality of coupling heads 16 and include a plurality of coupling-free or coupling-head-free sections 17 where leading fastener elements nearest to each opening 14 and their following one or more elements are void of at least their coupling heads. A plurality of top end stops 18 are applied to the fastener stringers 10,10 at their portions where the coupling-free or the coupling-head-free section 17 are located.

A pair of slide fastener stringers of continuous or substantially endless length of the present invention are constructed and manufactured as discussed hereinabove. If the continuous fastener stringers 10A thus muanufactured and constructed are cut, for example with scissors, at their minor-width outer side portions **11*a*,11*a* along the extensions of the longer diagonal line 14*a* of diamond of the openings 14, a plurality of individual slide fastener lengths 10B** can be obtained.

Referring again to FIG. 3, the individual slide fastener stringer length 10B is attached to the garment 20 so that the closure opening 19 can be fully covered with the individual slide fastener 10B. Specifically, the longitudinal marginal edges 21,21 partly defining the closure opening 19 registers to their outer longitudinal edges **11*b*,11*b* of the stringer tapes 10,10, respectively. The slide fastener length 10B is attached to the garment by securing the outer longitudinal edges 11*b*,11*b* and the longitudinal marginal edges 21,21 together, with a pair of rows of stitches 22,22, respectively, leaving the lower portions of the fastener stringer length 10B unstitched so as to allow the slider S to be applied to the coupled fastener element rows 12,12** in the direction of an arrow A.

Then, a bottom end stop means (not shown) for preventing the unexpected splitting of the coupled fastener element rows 12,12 is furnished on the element rows at their lower end portions **12*a*, after the slider S has been slidably moved upwardly, in FIG. 3, along the element rows 12 beyond the transverse marginal edge 23 partly defining the openings 19 and while the same being held stationary there. Thus, the attachment of a single individual slide fastener length with a slider to a garment is fully finished, if the lower portions of the individual fastener stringer length 10B** are attached to the garment by stitching them together.

There are other preferred ways to prevent the unexpected splitting of the coupled element rows 12 without the bottom end stop. For example, the trailing end portions **10*a*,10*a* of the coupled fastener stringers 10,10 may be attached to the garment 20 with one or more rows of stitches running transversely across the coupled fastener stringers 10,10. Another preferred way is to stitch the fastener stringers 10,10 to the garment 20 but with the trailing end portions 10*a*,10*a*** folded downside side.

In the embodiment discussed, the openings 14 have been shown and described as being of a substantially diamond-shaped with its longer diagonal line **14*a* running substantially at right angles with respect to the fastener element rows 12,12**. However, the present invention is not limited to this form of openings, and the opening may be of a rectangle. Moreover, the openings may be elliptical or any form as desired.

While specific invention have been shown and described in detail to illustrate the application of the principles of the invention, it will be understood that the invention may be embodied otherwise without departing from such principles.

What is claimed is:

1. A pair of slide fastener stringers of continuous length comprising: a pair of opposed stringer tapes of continuous length and containing thermoplastic fibers; a pair of rows of fastener elements having interengageable coupling heads and carried on and along the respective confronting inner longitudinal edges of said stringer tapes, thread means securing said rows of fastener elements to the respective stringer tapes; and a plurality of top end stops attached to said rows of fastener elements, said stringer tapes having a plurality of openings each disposed at substantially equal intervals and extending transversely across the rows of fastener elements when coupled and beyond the width of a slider and defining a substantially diamond-like configuration with the longer diagonal of the diamond oriented generally normal to said rows of fastener elements and being of a length such that the opening terminates short of the outer longitudinal edges of the respective stringer tapes and forms a substantially V-shaped cut portion at one direction of the rows of fastener elements when coupled said rows of fastener elements including a plurality of coupling head-free sections each arranged immediately adjacent to said opening and opposite to said V-shaped cut portion, said top end stop being disposed at their portions where said coupling head-free sections are located, and the fibers of said stringer tapes being fused together at and along marginal edges defining said openings by thermoplastic material derived solely from the thermoplastic fibers of said stringer tapes.

2. A pair of slide fastener stringers according to claim 1 wherein said thread means is formed of thermoplastic fibers and fused together at the marginal edges of said openings.

* * * * *